US006120424A

United States Patent [19]

Arline

[11] Patent Number: 6,120,424

[45] Date of Patent: Sep. 19, 2000

[54] BODY BUILDING APPARATUS

[76] Inventor: Clayton Arline, 75 Kingsley St., Springfield, Mass. 01103

[21] Appl. No.: 09/134,905

[22] Filed: Aug. 17, 1998

Related U.S. Application Data

[60] Provisional application No. 60/056,863, Aug. 22, 1997.

[51] Int. Cl.[7] ..... B63B 21/02

[52] U.S. Cl. ..... 482/121; 482/122; 482/125

[58] Field of Search ..... 482/121, 122, 482/125, 124, 126

[56] References Cited

U.S. PATENT DOCUMENTS

| | | | |
|---|---|---|---|
| 1,019,861 | 3/1912 | Titus . | |
| 2,223,309 | 11/1940 | Swanson | 482/123 |
| 3,068,003 | 12/1962 | Portman et al. . | |
| 3,117,781 | 1/1964 | Vargo . | |
| 3,119,614 | 1/1964 | Berry . | |
| 3,359,802 | 12/1967 | Sollenberger . | |
| 3,740,033 | 6/1973 | Kamp . | |
| 3,985,354 | 10/1976 | Schulkin . | |
| 4,326,708 | 4/1982 | Hinds . | |
| 4,371,162 | 2/1983 | Hartzell . | |
| 5,653,665 | 8/1997 | Neeley | 482/123 |
| 5,776,041 | 7/1998 | Fisher | 482/124 X |

*Primary Examiner*—Jerome W. Donnelly
*Attorney, Agent, or Firm*—Richard C. Litman

[57] ABSTRACT

The body building apparatus of the present invention has two cylindrical bars, the bars having a gripping surface and optionally being enclosed within a cushioned tubular pad, the bars being releasably connected at opposing ends by two flexible, elastically extendible side members of equal length so that the cylindrical bars and the side members define a rectangle. In an alternative embodiment, a pair of ceiling hooks replace one of the cylindrical bars, the elastically extendible side members being suspended from the ceiling hooks at one end and supporting a cylindrical bar at the other end, the ceiling, the cylindrical bar, and the side members defining a rectangle. In both embodiments, the side members extend to a maximum length under tension between about 20% to 30% greater than their length at rest. The apparatus is used to perform isotonic exercises by anchoring one of the cylindrical bars with a body member and repetitively exerting tension against the resistance of the elastically extendible side members by pulling the other cylindrical bar.

14 Claims, 4 Drawing Sheets

BODY BUILDING APPARATUS

CROSS-REFERENCE TO RELATED APPLICATION

This application claims the benefit of U.S. Provisional Patent Application Ser. No. 60/056,863, filed Aug. 22, 1997.

BACKGROUND OF THE INVENTION

1. Field of the Invention

The present invention relates generally to compact, portable muscular development exercise devices and, more specifically, to an isotonic exercise device including at least one rigid bar and a pair of detachable, flexible, elastically extendable cords.

2. Description of Related Art

It is recognized that free standing wrought iron weights used for muscular development exercises, or barbells as they are commonly known, are cumbersome and unwieldy. Similarly, the muscular development exercise machines found in most health clubs and gyms are large, heavy, expensive apparatuses. Furthermore, any given gym machine is generally capable of exercising only one muscle group or a small number of muscle groups. Thus, there is a need for a muscular development exercise device that is lightweight, compact, and capable of exercising and developing practically every major muscle group in the human body. Preferably, such an exercise device should also be sufficiently compact to be stored and transported in luggage or in a drawer or on a shelf when not in use.

Exercise devices may be broadly classified as either isometric or isotonic. An isometric device operates on the principle of muscular contraction without motion, either by pushing or pulling against a rigid object, or by pushing or pulling opposing flexor and extensor muscles in order cause tension without motion. Proponents of isometrics claim that isometric contraction of the muscles strengthens muscles as well and as quickly as isotonic exercise. Isotonic exercise is exercise with motion. It is generally said that the more isotonic exercises are done, the more they must be repeated to have value. Proponents of isotonic exercise claim it results in faster development of the size of muscles. Various isometric and isotonic devices have been proposed to fulfill the above mentioned goals.

Isometric devices are described in U.S. Pat. No. 3,068,003, issued to Portman, et al. on Dec. 11, 1962, U.S. Pat. No. 3,117,781, issued Jan. 14, 1964 to L. M. Vargo, and U.S. Pat. No. 3,119,614, issued Jan. 28, 1964 to D. E. Berry. Portman describes a device having two end members, one a hollow tube and the other a spread device including foot pads and hand grips, joined by a flexible but inelastic line, such as nylon, and means for adjusting the length of the cord. The Vargo device includes a platform which may be cushioned by carpeting on which the user stands, and a bar cushioned in the center by rubber or cork, the platform and the bar being joined by two inextensible cords, the length of the cords being adjusted by winding the cords around the bar. The exercises performed with the Portman and Vargo devices all require standing on the end member or platform. The Barry device has two rigid members in the form of bars, one of which has end caps to protect the floor when standing on the member, and flexible but nonelastic webbing, the ends of each bar fitting through loops in the webbing to adjust the separation between the bars.

A number of isotonic devices have been proposed. U.S. Pat. No. 1,019,861, issued to H. W. Titus on Mar. 12, 1912, shows an exercise device having a cylindrical upper member and a flat rectangular lower member connected by two flexible, elastically extendable members. All exercises with the Titus device are performed while standing on the lower member. U.S. Pat. No. 3,359,802, issued to C. E. Sollenberger on Dec. 26, 1967, discloses a device which includes a bar attached at either end to the pistons of a pair of hydraulic cylinders, the cylinders being pivotally attached to U-brackets. The Sollenberger device is neither portable nor compact. U.S. Pat. No. 3,740,033, issued Jun. 19, 1973 to C. D. Kamp describes a curved platform with two straps attached to opposite ends of the platform, the other ends of the straps being attached to a bar and rolled around the bar. The exerciser grasps the bar with gloves while standing on the platform, the bar rotating in the gloves as the straps unroll, the tension being governed by the strength of the exerciser's grip on the bar.

U.S. Pat. No. 3,985,354, issued to W. Schulkin on Oct. 12, 1976, discloses a device having a top element, a bottom element, and a pair of concentric telescoping cylindrical tubes biased by heavy duty springs defining a rectangular shape, the four sides being bolted together. U.S. Pat. No. 4,326,708, issued Apr. 27, 1982 to R. S. Hinds teaches a bar connected to two stirrups by elastic cords, the bar having finger-like projections and grooves, the cord being wound on the bar by rotating the bar. U.S. Pat. No. 4,371,162, issued to R. P. Hartzel on Feb. 1, 1983, shows a foot board on a base having a pair of continuous elastic loops extending through angulated slots. The loops may be positioned over the user's shoulders for squatting exercises.

Some individuals have respiratory, metabolic, circulatory, or other physical infirmities which prevent the use of barbells or gym machines to exercise muscles. Likewise, some individuals have physical limitations requiring that muscular exercise take place from a seated, reclined, or standing position. For example, large heavy barbells and gym machines are impractical for use by bed ridden residents of a retirement community who wish to exercise despite their physical impediment, or by wheelchair bound college students who wish to train for a wheelchair basketball tournament. Thus, there is a need for a muscular exercise device that can be easily and safely used at home from a seated, reclined, or standing position and by individuals with physical infirmities.

Many exercise devices are not adaptable or acceptable for use by individuals of all sizes. Accordingly, there is a need for a muscular exercise device usable by children, small adults and large adults. Similarly, many exercise devices are not ideal for use by individuals of widely divergent relative levels of muscular strength. So, there is a need for a muscular exercise device adaptable for use by individuals having widely divergent relative levels of physical strength.

None of the above inventions and patents disclose the use of two generally cylindrical rigid bars having different weights. Similarly, none of the above inventions and patents disclose the use of ceiling hooks or a detachable fastening means in cooperation with a flexible, elastically extendible member. Likewise, none of the above inventions and patents, taken either singly or in combination, is seen to describe the instant invention as claimed.

SUMMARY OF THE INVENTION

The present invention is a body building apparatus comprising two cylindrical bars, the bars having a gripping surface and optionally being enclosed within a cushioned tubular pad, the bars being releasably connected at opposing ends by two flexible, elastically extendible side members of equal length so that the cylindrical bars and the side members define a rectangle. In an alternative embodiment, a pair of ceiling hooks replace one of the cylindrical bars, the elastically extendible side members being suspended from the ceiling hooks at one end and supporting a cylindrical bar at the other end, the ceiling, the cylindrical bar, and the side members defining a rectangle. In both embodiments, the side members extend to a maximum length under tension between about 20% to 30% greater than their length at rest. The apparatus is used to perform isotonic exercises by anchoring one of the cylindrical bars with a body member and repetitively exerting tension against the resistance of the elastically extendible side members by pulling the other cylindrical bar.

The present invention also consists of a kit embodiment that includes at least one pair of cylindrical bars having a gripping surface, the bars of each pair having the same length, a number of cushioned tubular pads equal to the number of rigid bars and having substantially the same length as the bars, a pair of substantially similar ceiling hooks, and at least two pairs of side members, each pair of side members having a unique predetermined length and a means of releasably connecting the ends of the side members to an end of a cylindrical bar or to a ceiling hook.

Accordingly, it is a principal object of the invention to provide a lightweight, compact, portable device capable of exercising and developing practically every major muscle group in the human body with a magnitude of resistance comparable to the resistance provided by free weights or muscular development exercise machines.

It is another object of the invention to provide a muscular development exercise device that utilizes an extendible member to perform relatively short, repetitive exercise movements when in use.

It is a further object of the invention to provide a muscular development exercise device capable of being operated by individuals having physical limitations prohibiting certain strenuous exercise.

It is a related object of the invention to provide a muscular development exercise device capable of use by the bedridden, the wheelchair bound, or individuals having other exercise constraints affecting posture or mounting arrangements.

Still another object of the invention is to provide a muscular development exercise device capable of use by individuals of all sizes and levels of strength.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a compact, portable, muscular development exercise device capable of two modes of use, the modes having some elements in common, and a kit comprising the elements necessary to assemble the device for either mode of use.

Figure 1:
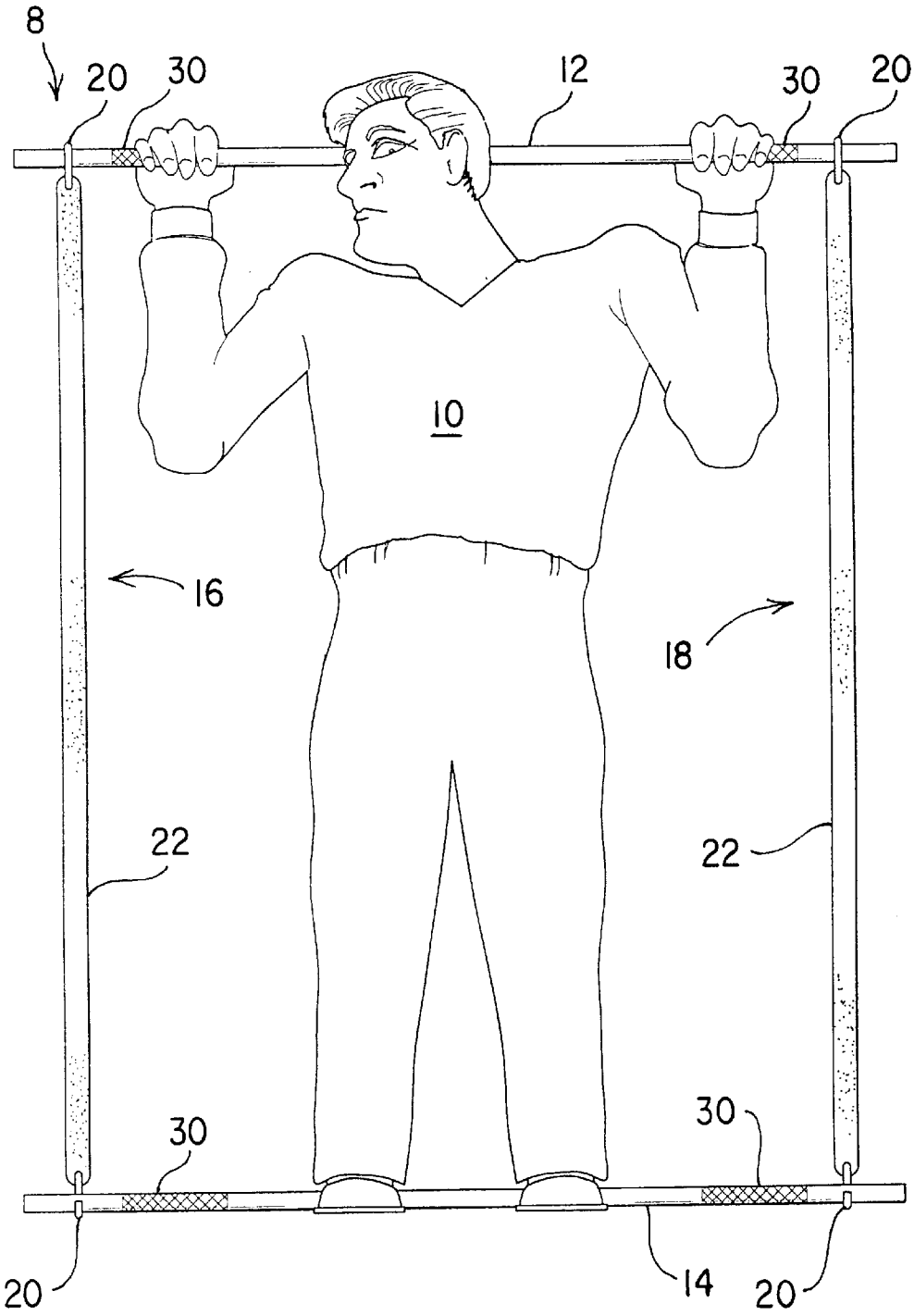
FIG. 1 is an environmental front view of an individual performing a press behind the neck using the body building apparatus according to the present invention.

Before explaining the present invention in detail, it is to be understood that the invention is not limited in its use and application to the exercise illustrated in FIG. 1. The invention is capable of use in a variety of different types of exercises, limited only by the creativity of the user.

Referring to FIG. 1, an exerciser 10 is shown performing a repetition of an exercise known as a press behind the neck from a standing position with a first embodiment of the body building apparatus 8. The first embodiment of the body building apparatus 8 includes a first substantially rigid cylindrical bar 12 and a second substantially rigid cylindrical bar 14, as shown in FIG. 1. Preferably the cylindrical bars 12 and 14 have the same length and diameter. The cylindrical bars 12, 14 may be either solid or hollow and tubular. The cylindrical bars 12, 14 have a grip means, such as the knurled hand grips 30 shown in FIGS. 1 and 2 to enhance gripping or frictionally engaging the bars 12, 14, with the hands, feet or other part of the body in order to reduce slipping.

The apparatus 8 includes a first side member 16 and a second side member 18. The ends of the side members 16, 18 are releasably connected to the cylindrical bars 12, 14 by any conventional means at or substantially near their ends so that the cylindrical bars 12, 14 are parallel to each other and the side members 16, 18 are parallel to each other. The first 16 and second 18 side members are flexible, elastically extendible cords 22, preferably having the same length, in order to define a rectangle in conjunction with the rigid members 12, 14, the rectangle being sufficient for the exerciser to dispose his torso between the side members from shoulder to shoulder. In the embodiment shown, the side members 16, 18 have hooks 20 at the ends of the cords 22 adapted for releasably connecting the side members 16, 18 to the cylindrical bars 12, 14.

Prior inventions have referred to such extendible members in broad terms as merely being elastic, or in the case of springs, as being heavy duty or light duty. Nevertheless, the extensibility of an elastic or spring member can vary greatly, depending on the modulus of elasticity or the spring constant. It is a limitation of the side members 16, 18 of the present invention that the maximum increase in length of the cords 22 when placed under tension falls within defined limits. The apparatus 8 of the present invention is designed to be used with repetitive movements against the resistance of the elastic cords 22, with the maximum benefit being derived from slow movements. Consequently, the maximum increase in length of the cord 22 is between about 20% and 30%. That is, for an eighteen inch cord 22, the maximum length it may extend to is between about twenty-one to twenty-four inches. Similarly, the maximum length a forty inch cord 22 may extend to is between about forty-eight to fifty-two inches.

This prevents the body of the exerciser 10 from being subjected to the sharp, jerky repetitions that typify an exercise performed with free weights and gym machines and lowers or eliminates the anatomically harmful aspects of physical exercise without eliminating the beneficial effects of muscular development. By varying the elastic properties of the elastic cords 22, the magnitude of resistance varies. Thus, the exercise device 8 is suited for a strong exerciser 10 when the magnitude of resistance provided by the elastic cords 22 is high and suited for an exerciser 10 having lesser strength when the magnitude of resistance provided by the elastic cords 22 is lower. It has been observed that the exercise device 8 provides a level of resistance equivalent to the level of resistance achieved by free weights and muscular development exercise machines.

In the preferred embodiment, the elastic members 16, 18 are the product commonly known as a bungee cord having a metal hook attached to both ends.

FIG. 1 shows the resting position in an exercise known as the press behind the neck. In performing a repetition of this exercise, the exerciser 10 forces his arms to raise the bar 16 above his head. As the exerciser 10 forces his arms above his head, the elastic cords 22 and the hooks 20 are subjected to a stress, causing the cords 22 to stretch. In the press behind the neck, the stress to the elastic cords 22 and the hooks 20 is applied by forces generated by the exerciser's 10 muscles, the triceps, deltoids (shoulders) and the trapezius in particular, strengthening these muscle groups.

In the press behind the neck exercise illustrated, the cylindrical bar 14 is anchored by the feet of the exerciser 10. By varying the posture of the exerciser 10 and by varying the part of the exerciser's 10 anatomy which opposingly contacts the cylindrical bars 12 and 14, practically every major muscle group in the body of the exerciser 10 can be exercised and developed by the exercise device 8. Modified versions of other weight lifting exercises which may be performed with the apparatus 8 include a biceps curl, a french curl, and an upright row, performed by manipulating the cylindrical bar 12 with the hands in front of the body while cylindrical bar 14 is anchored below the feet in the standing position illustrated. Additionally, by anchoring the cylindrical bar 12 on the shoulders behind the neck, the exerciser 10 performs squats, calf raises, back extensions and side bends to develop the leg muscles, gastrocnemius, the spinalis dorsalis (erector spinal) and the latissimus dorsal (lats), and the external and internal oblique muscles respectively from the standing position illustrated. Reclined to a supine position with the bar 14 anchored under his back, the exerciser 10 uses his pectorals, frontal deltoids, and triceps while forcing the bar 12 laterally away from his torso in an exercise commonly known as the bench press.

By spreading his feet, anchoring the center of the bar 14 under one foot, and grasping the center of the bar 12 with the hand on that side of his body, the exerciser 10 uses his trapezius (traps), rhomboids, and lats to raise the bar 12 away from the floor. Further, by placing the bar 12 outside one ankle and placing the bar 14 outside his other ankle, the exerciser 10 uses his abductors (outer thigh) to separate his legs. The exerciser 10 may perform a press from a sitting position by anchoring the 14 with his buttocks rather than with his feet as pictured.

The versatility of the exercise device 8 with regard to posture and set up is particularly beneficial when the exerciser 10 is a person confined to a bed or a wheelchair. Since they are cumbersome, unwieldy, and not portable, free standing wrought iron weights and the muscular development exercise machines found in most health clubs and gyms are often impractical to use when the exerciser 10 is physically challenged. Consequently, physically challenged individuals often complain that they lack access to forms of exercise available to the physically well. In some cases, this deficiency results in a psychological state of depression. The exercise device 8 overcomes this difficulty. For example, instead of anchoring the bar 14 under the back of a supine exerciser 10, the bar 12 is anchored underneath a bed for the exerciser 10 to perform a bench press while laying in the bed. Naturally the length of the bars 12, 14 in an embodiment of the exercise device 8 designed for use by an exerciser 10 in a bed must be greater than the width of the bed.

Similarly a multitude of exercises are possible for an exerciser confined to a wheelchair by anchoring one of the bars 12, 14 under the seat of the wheelchair. Many other exercises can be performed by varying the relative positions of the cylindrical bars 12 and 14 with respect to each other and with respect to parts of the body of the exerciser 10 in the manner taught above. Similarly, just as a bed or a wheelchair will anchor one of the bars 12, 14 as described above, other inanimate objects such as a chair may be used to anchor one of the bars 12, 14. The versatility of the exercise device 8 is limited only by the creativity of the exerciser 10.

It is believed that the benefit of an exercise performed with the exercise device 8 is improved when the exerciser 10 performs the exercise in a balanced manner. In the most balanced position, the hands and feet of the exerciser 10 are spaced an equal distance from the center and ends of the bars 12, 14. When other parts of the anatomy of the exerciser 10 are used in an exercise, the most balanced position is centered on the bars 12, 14. To aid in determining the balanced position on the bars 12, 14, a center line may be provided indicating the center of the bars 12, 14 and the distance from the center of the bars 12, 14 to the ends of the bars 12, 14 may be ruled.

The side members 16, 18 may be releasably connected to the rigid members 12, 14 by any conventional means. As shown in the FIGS. 1 and 2, the hooks 20 may be looped around the outside of the cylindrical bars 12, 14. Alternatively, the hooks 20 may be inserted through one or more holes defined in the cylindrical bars 12, 14. Yet another method is illustrated by the cylindrical bar 12 in FIG. 3. The third means incorporates a thin flange 26 attached to the ends of the bars 12, 14. In the third means of detachably connecting, the hook 20 is looped through an eye 28 in the flange 26. The recommended means of attaching the flange 26 to the end of the bars 12, 14 is through the use of a mating male and female threaded connection between the flange 26 and the bars 12, 14. Alternatively, the flange 26 is fixedly attached to the ends of the bars 12, 14.

In the preferred embodiment, the cylindrical bars 12 and 14 have the same length, diameter, and weight. The bars 12 and 14 may be either solid or hollow and tubular. In alternative embodiments the bars 12, 14 may have different weights, either by making one bar solid and the other bar hollow, by having two hollow bars of different thicknesses, by making the bars of different materials, etc. The effort required to lift the bar 12 may then vary depending on the weight of the bar as well as the tension of the cords 22. The lighter bar may be used as a warm up bar for setting up exercising before proceeding to a usual exercise routine.

The bars 12 and 14 may be made in pairs having different lengths. A pair of bars 12, 14 three feet in length of light weight aluminum might be suitable for children, or desirable for improved portability of the apparatus 8, although decreasing the range of exercises which may be performed. A professional strength or fitness competitor may find a pair of bars 12, 14 as much as eight feet in length and one hundred pounds in weight suitable.

Figure 2:
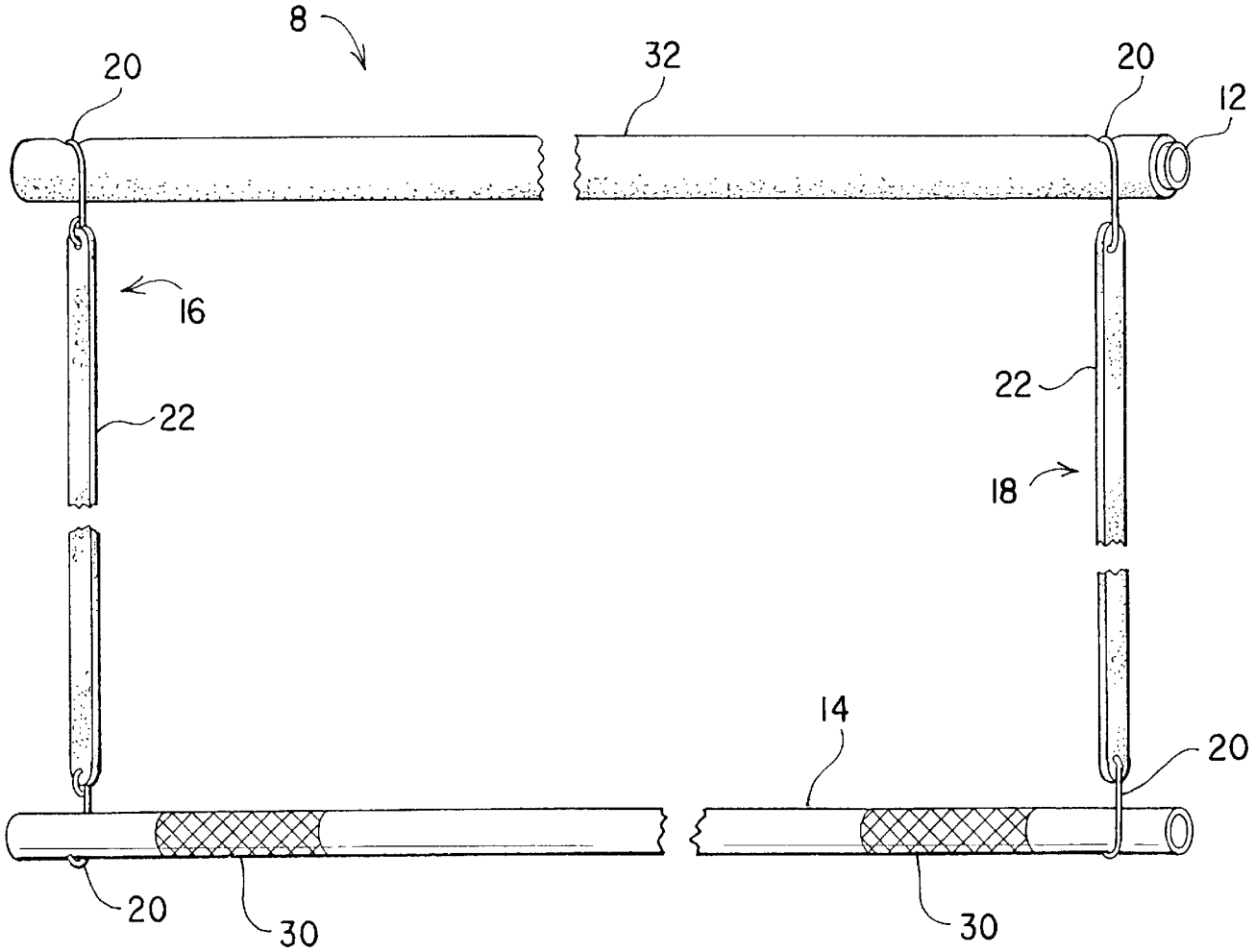
FIG. 2 is a fragmented perspective view showing details of the various elements of a body building apparatus according to the present invention.

With the exception of the bar 12 in FIG. 2, the bars 12, 14 are shown with a grip 30 near both ends of the bar 12, 14. Another alternative feature of the present invention is a tubular pad 32. The pad 32 is designed to slide on and off the bars 12, 14 and improve the safety and comfort of the exercise device 8 when it is on the bars 12, 14. Thus, the pad 32 is cushioned, tubular, and of substantially the same length as the bars 12, 14. A pad 32 may be placed on one or both bars 12, 14 to provide a cushion to protect the floor from scraping or marring, to protect the finish on the bars 12, 14, or to cushion the body against the feel of the metal surface of the bar 12, 14, at the option of the exerciser 10.

Figure 3:
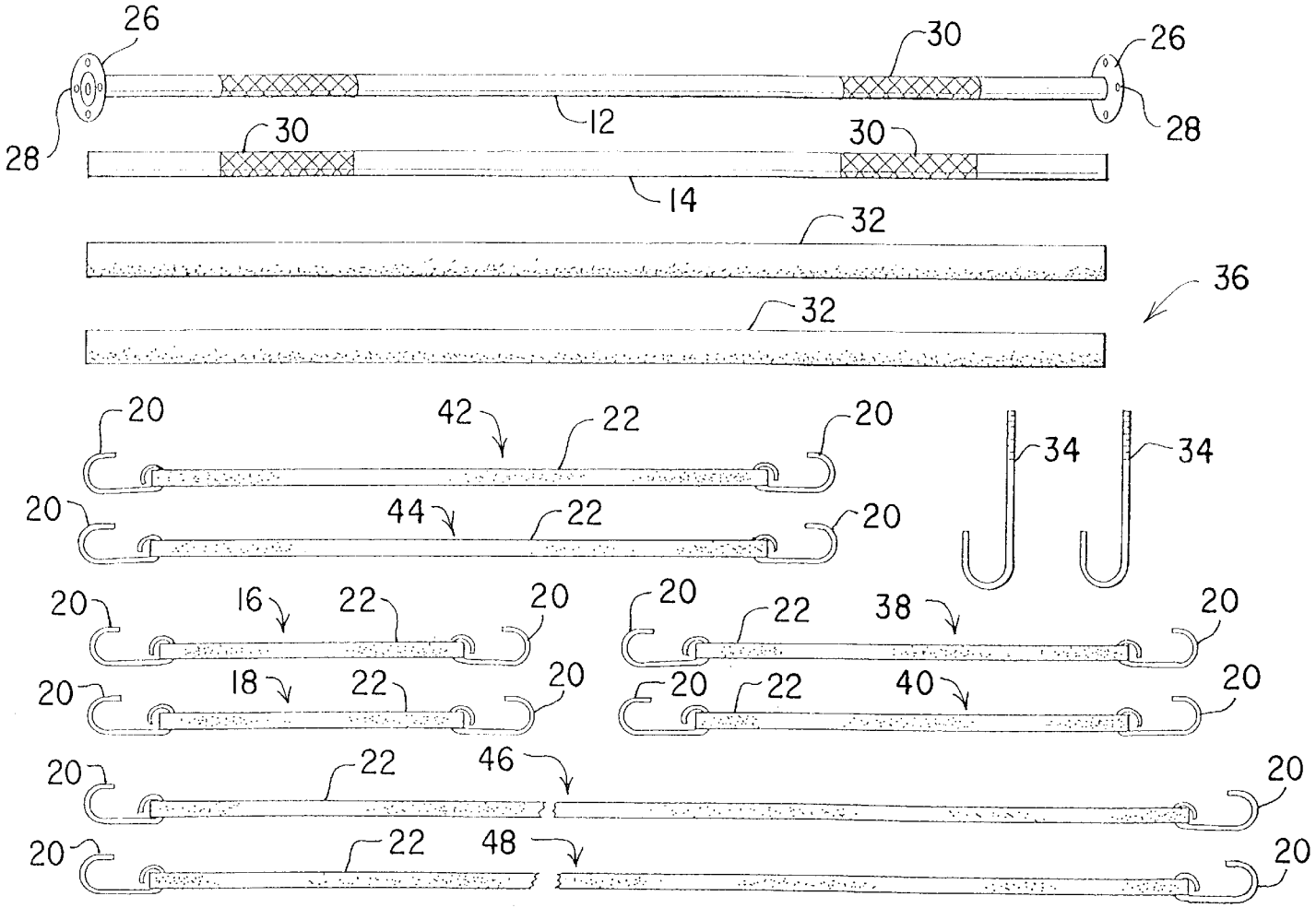
FIG. 3 is a plan view of a kit of various elements included in a body building apparatus according to the present invention.

Referring now to FIG. 3, the second mode of use of the exercise device is distinguishable from the first mode of use described above in that a pair of ceiling hooks 34 is substituted for one of the cylindrical bars 12 or 14. The ceiling hooks 34 are anchored in a ceiling, a wall, or some other immovable surface in the second mode of use. The distance separating the mounted ceiling hooks 34 is substantially equal to the length of the bar 12 or 14. The hooks 20 at one end of each of the side members 16, 18 are attached to the ceiling hooks 34 and the hooks 20 at the other end of the side members are attached to the bar 12 or 14 in order to define a rectangular shape.

The second mode of use is beneficial because it enables exercises for certain important muscular group that are difficult to isolate with an exercise in the first mode of use described and illustrated. More specifically, by anchoring the ceiling hooks 34 in a wall or some other immovable vertical surface, various exercises are enabled which isolate the abdominal muscles, the tibialis anterior (shin), the iliopsoas (hip flexors), the adductors (inner thigh), the gluteus maximus (buttocks) and the hamstrings (back of thigh) in a way not available from the first mode of use. For example, to isolate the abdominal muscles with an exercise in the second mode of use, the exerciser 10 places the bar 12 or 14 in front of his chest while seated with the side members 16, 18 anchored by the ceiling hooks 34 in a wall behind his back. Then, the exerciser 10 leans his torso forward. It should be apparent that the other muscle groups benefitting from this second mode are isolated by similar exercises. Thus, by combining the first mode of use and the second mode of use, the exercise device 8 is capable of exercising and developing practically every major muscle group in the human body.

It is suggested that the exercise device be made available in the form of a kit 36. FIG. 3 illustrates the elements of a preferred embodiment of the kit 36, those elements being a first cylindrical bar 12, a second cylindrical bar 14, a pair of pads 32 for use with the cylindrical bars 12, 14, two ceiling hooks 34, and a first side member 16, a second side member 18, a third side member 38, a fourth side member 40, a fifth side member 42, a sixth side member 44, a seventh side member 46, and an eighth side member 48. Just as the first side member 16 and the second side member 18 form an identical pair, the third side member 38 and the fourth side member 40 form an identical pair, the fifth side member 42 and the sixth side member 44 form an identical pair, and the seventh side member 46 and the eighth side member 48 form an identical pair. The additional outer members 38–48 provided with the kit 36 conform with the description of the elastic members 16, 18 above. The four pairs of side members 16–18, 38–40, 42–44, 46–48 differ only in length, preferred lengths being eighteen inches, thirty inches, forty inches and seventy-two inches respectively.

Figure 4:
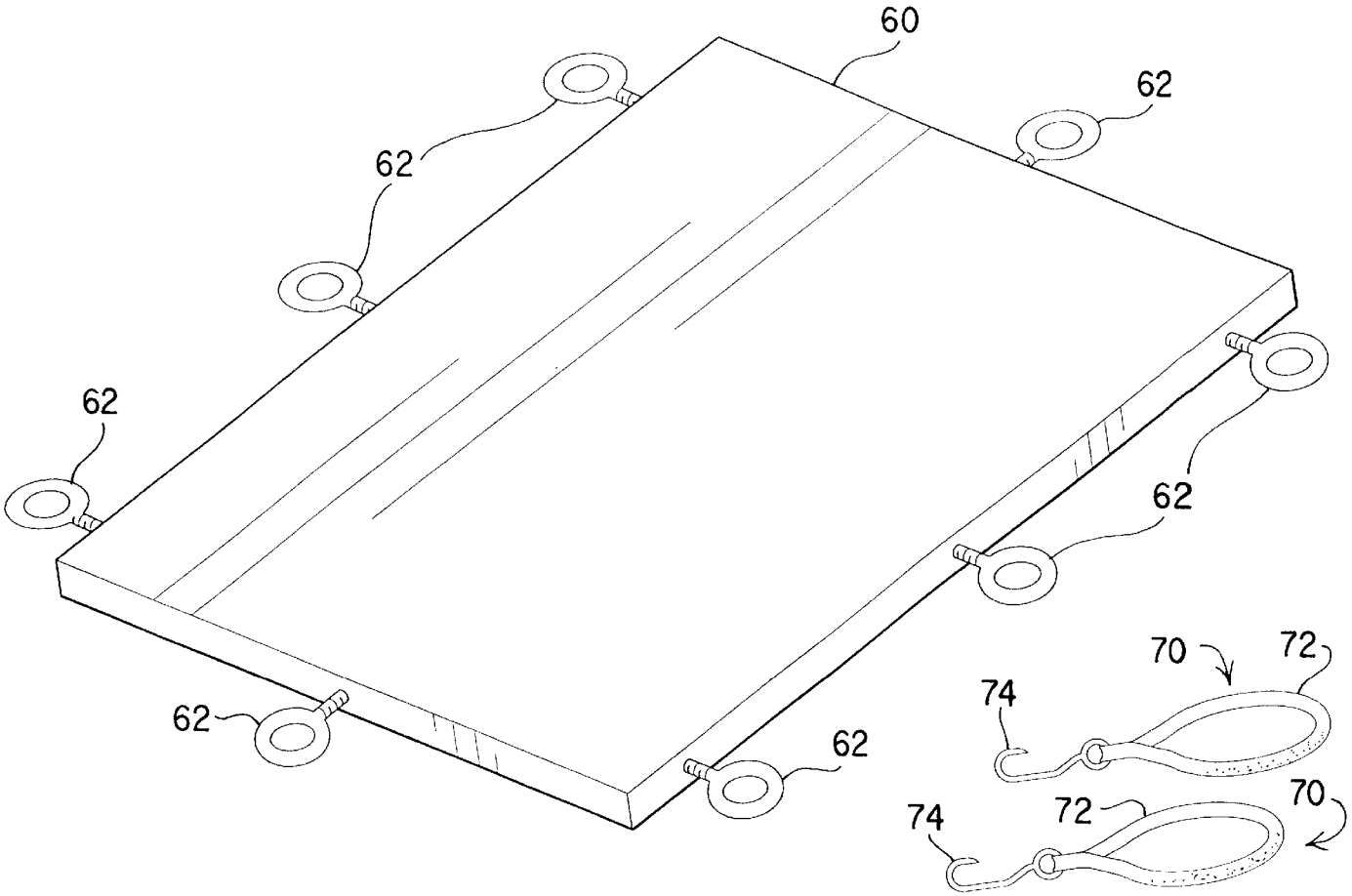
FIG. 4 is a plan view of optional additional elements which may be included in the kit of FIG. 3.

FIG. 4 shows two additional components which may optionally be included in the kit 36, a rectangular platform 60 and an adaptor loop 70. The platform 60 is a flat surface which the exerciser 10 may use to lie on while performing bench presses, to sit while with the legs extended and one of the bars 12 or 14 hooked beneath the feet, to substitute for one of the cylindrical bars 12, 14 while performing standing exercises, etc. The platform also has means on the edges adapted for receiving ceiling hooks 34, such as eyebolts 62, in order to temporarily mount the platform 60 on the wall or ceiling, and also adapted to receive the hooks 20 of the side members 16 and 18. The adaptor loop 70 is a loop 72 made from a tough flexible material having a hook 74 attached. The hook 74 is adapted for temporarily engaging the cylindrical bars 12 and 14. The loops 70 are adapted for use by handicapped individuals who lack sufficient hand strength to grasp the cylindrical bars 12, 14 with their hands, but who are able to slip their arms through the loops 70 in order to pull the cylindrical bar 12 with their arms. It might also be used by inserting a leg through the loop 70 to exercise the leg muscles. The loop adaptor 70 may also be made in the shape of a "Y" (not shown), with two loops connected to a central cord having a hook at the end adapted for temporarily engaging cylindrical bars 12, 14. While particularly adapted for use by the handicapped, the loop adaptor 70 may also be used by the non-handicapped who prefer not to grasp the cylindrical bar 12, 14 directly. The loop adaptor 70 may be furnished in the kit 36 in pairs.

It is to be understood that the present invention is not limited to the embodiments described above, but encompasses any and all embodiments within the scope of the following claims.

I claim:

1. A body building apparatus for isotonic exercising of the muscles of a human body, comprising:

a) a first substantially rigid cylindrical bar;

b) a second substantially rigid cylindrical bar having the same length as said first cylindrical bar, said first and second cylindrical bars having gripping means for frictionally engaging the bars with a part of a human body and said first cylindrical bar and said second cylindrical bar having substantially different weights;

c) a first side member;

d) a second side member, said first and second side members being flexible, elastically extendible cords, said first and second side members being releasably connected to said first and second cylindrical bars at opposite ends of said bars so that said cylindrical bars and said side members define a rectangular shape having said cylindrical bars parallel to each other and said side members parallel to each other, the rectangle being sufficiently wide in order to dispose a human body between the side members from shoulder to shoulder; and e) wherein said first and second side members extend under tension to a maximum length between twenty percent and thirty percent greater than their length at rest, whereby said body building apparatus is adapted for performing repetitive exercise movements opposed by the tension of said side members.

2. The body building apparatus according to claim 1, wherein said gripping means comprises knurled hand grips.

3. The body building apparatus according to claim 1, wherein:

a) said first side member further comprises a first hook attached to an end of said first side member and a second hook attached to the other end of said first side member, said hooks being adapted for releasably connecting said first side member to said first and second cylindrical bars; and b) said second side member further comprises a first hook attached to an end of said second side member and a second hook attached to the other end of said second side member, said hooks being adapted for releasably connecting said second side member to said first and second cylindrical bars.

4. The body building apparatus according to claim 1, further comprising at least one cushioned, tubular shaped pad adapted for being disposed about one of said cylindrical bars.

5. The body building apparatus according to claim 1, wherein at least one of said cylindrical bars is adapted for anchoring under the seat of a wheelchair, whereby the apparatus may be adapted for exercising the body of an individual occupying the wheelchair.

6. The body building apparatus according to claim 1, wherein said first and second cylindrical bars are solid.

7. The body building apparatus according to claim 1, wherein said first and second cylindrical members are tubular.

8. The body building apparatus according to claim 1, wherein at least one of said cylindrical bars is adapted for anchoring under the frame of a bed, whereby the apparatus may be adapted for exercising the body of an individual confined to bed.

9. A body building apparatus kit, comprising:

a) a first substantially rigid cylindrical bar;

b) a second substantially rigid cylindrical bar having the same length as said first cylindrical bar, said first and second cylindrical bars having gripping means for frictionally engaging the bars with a part of a human body and said first cylindrical bar and said second cylindrical bar having substantially different weights;

c) a plurality of pairs of side members, said side members being flexible, elastically extendible cords adapted for being releasably connected to said first and second cylindrical bars, the side members of each pair being equal in length, each pair having a unique predetermined length;

d) a first ceiling hook and a second ceiling hook, the ceiling hooks being adapted for mounting to the ceiling or wall of a building;

e) wherein said first and second side members extend under tension to a maximum length between twenty percent and thirty percent greater than their length at rest, whereby said body building apparatus is adapted for performing repetitive exercise movements opposed by the tension of said side members.

10. The body building apparatus kit according to claim 9, wherein said gripping means comprises knurled hand grips.

11. The body building apparatus kit according to claim 9, wherein each side member of said plurality of pairs of side members further comprises a first hook attached to an end of said side member and a second hook attached to the other end of said side member, said hooks being adapted for releasably connecting said first side member to said first and second cylindrical bars.

12. The body building apparatus kit according to claim 9, further comprising a pair of cushioned, tubular shaped pads adapted for being disposed about said cylindrical bars.

13. The body building apparatus kit according to claim 9, further comprising a platform, said platform being substantially rectangular in shape and having means disposed about its perimeter adapted for connection to said ceiling hooks and having means disposed about its perimeter for being releasably connected to said side members.

14. The body building apparatus kit according to claim 9, further comprising at least one adaptor loop, the adaptor loop having a loop adapted for receiving a limb of a human body and having means for temporarily engaging said cylindrical bar, whereby said cylindrical bar may be manipulated by said adaptor loop during body building exercises.

* * * * *